US008750748B2

(12) United States Patent
Suzuki

(10) Patent No.: US 8,750,748 B2
(45) Date of Patent: Jun. 10, 2014

(54) TONER CONVEYING DEVICE OR IMAGE FORMING APPARATUS HAVING THE TONER CONVEYING DEVICE

(75) Inventor: Kazushi Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 343 days.

(21) Appl. No.: 13/166,566

(22) Filed: Jun. 22, 2011

(65) Prior Publication Data

US 2011/0318049 A1 Dec. 29, 2011

(30) Foreign Application Priority Data

Jun. 25, 2010 (JP) ..... 2010-145310

(51) Int. Cl.
*G03G 15/16* (2006.01)

(52) U.S. Cl.
USPC ..... 399/101

(58) Field of Classification Search
USPC ..... 399/101, 99, 123, 358
See application file for complete search history.

(56) References Cited

U.S. PATENT DOCUMENTS

| | | | | |
|---|---|---|---|---|
| 5,815,784 | A * | 9/1998 | Kasahara et al. | 399/358 |
| 8,346,151 | B2 * | 1/2013 | Akaike et al. | 399/358 |
| 2005/0002708 | A1 * | 1/2005 | Jeong et al. | 399/358 |
| 2009/0003871 | A1 * | 1/2009 | Matsumoto | 399/101 |
| 2009/0067873 | A1 * | 3/2009 | Gunbe | 399/99 |
| 2010/0067964 | A1 * | 3/2010 | Yuyama | 399/358 |
| 2012/0219315 | A1 * | 8/2012 | Suzuki et al. | 399/101 |

FOREIGN PATENT DOCUMENTS

| | | | |
|---|---|---|---|
| CN | 101241343 | A | 8/2008 |
| JP | 2000-075614 | A | 3/2000 |
| JP | 2000-214741 | A | 8/2000 |
| JP | 2000-305354 | A | 11/2000 |
| JP | 2002-132111 | A | 5/2002 |
| JP | 2002-311712 | A | 10/2002 |
| JP | 2008-216360 | A | 9/2008 |

* cited by examiner

*Primary Examiner* — Walter L Lindsay, Jr.
*Assistant Examiner* — Rodney Bonnette
(74) *Attorney, Agent, or Firm* — Canon USA Inc IP Division

(57) ABSTRACT

This invention provides a toner conveying device including a toner hashing member having an opening region serving as a connecting region between the connection member and the toner conveying member and configured to break up a clump of toner accumulating in a toner conveying path in a region of the conveying path, which corresponds at least to the opening region, and an image forming apparatus including this toner conveying device.

23 Claims, 7 Drawing Sheets

FIG. 6

| WIRE ROD DIAMETER OF TONER HASHING MEMBER 206 [mm] | TONER DELIVERY TO TONER CONVEYING MEMBER 204 |
|---|---|
| 0.1 | ○ |
| 0.2 | ○ |
| 0.3 | ○ |
| 0.4 | ○ |
| 0.5 | ○ |
| 0.6 | ○ |
| 0.7 | × |
| 0.8 | × |
| 0.9 | × |
| 1.0 | × |

TONER CONVEYING DEVICE OR IMAGE FORMING APPARATUS HAVING THE TONER CONVEYING DEVICE

BACKGROUND OF THE INVENTION

1. Field of the Invention

The present invention relates to a toner conveying device to transport toner collected by a cleaning unit, or relates to an image forming apparatus using the toner conveying device.

2. Description of the Related Art

Conventionally, image forming apparatuses of electro photography using a toner include a cleaning unit to remove the toner remaining on the surface of a photosensitive drum or on the surface of an intermediate transfer member. Image forming apparatuses are known which convey the toner removed at the cleaning unit by the conveying member shoving the toner, such as a coil or a screw mounted in the toner conveying path, until the toner is discharged from the toner discharge port into the toner collecting box. Another image forming apparatus has been proposed which is configured differently, namely, the toner is conveyed in one direction by the conveying member until it is caused to fall, and fallen toner is further conveyed by another conveying member down to the toner discharge port. This configuration can give lots of freedom in selecting a position where the toner collecting box is located in the image forming apparatus.

Japanese Patent Application Laid-Open No. 2002-311712 discusses a configuration in which the toner removed by the cleaning unit is conveyed by a conveying member (first toner conveying member), and then the toner falls by its own weight into the toner conveying path. The toner that has fallen into the toner conveying path is led by another conveying member (second toner conveying member) to the toner discharge port. Moreover, Japanese Patent Application Laid-Open No. 2002-311712 proposes a configuration which has an oscillating unit arranged in the region of the toner conveying path where the toner falls by its own weight to make the oscillating unit oscillate to prevent the toner from building up and clogging the toner conveying path.

However, according to Japanese Patent Application Laid-Open No. 2002-311712, because the oscillating unit does not contact the second toner conveying member, there is an empty space between the oscillating unit and the second toner conveying member. Therefore, in this empty space, the oscillating unit is unable to break up a clumped toner.

The toner particles are likely to coagulate where they fall. Since the toner sometimes grows into large clumps at the toner fall position without being broken up by the oscillating unit, a load is added to the rotation of the second toner conveying member, often resulting in an unstable motion of the second toner conveying member.

SUMMARY OF THE INVENTION

The present invention is directed to a toner conveying device in a simple structure, which prevents toner from accumulating in a toner conveying path and ensures a stable conveyance of the toner to a collecting box or directed to an image forming apparatus including the toner conveying device.

According to an aspect of the present invention, a toner conveying device for conveying collected toner, includes an inflow port to which collected toner flows in, a toner conveying path having a discharge port, a connection member connecting the inflow port and the toner conveying path, a toner conveying member provided within the toner conveying path and configured to convey the collected toner, and a drive shaft configured to rotate and drive the toner conveying member. The toner conveying member, while rotating, conveys the toner which flows in from the inflow port, falls through the connection member and accumulates in the toner conveying path, from a position where the toner falls, in a direction of the discharge port. Further, the toner conveying device includes a toner hashing member having an opening region, wherein a toner hashing member configured to break up the accumulating toner in the toner conveying path, is provided in a region of the toner conveying path, corresponding at least to an opening region serving as a connecting region between the connection member and the toner conveying path.

According to another aspect of the present invention, an image forming apparatus for transferring a toner image onto transfer material includes an image bearing member carrying a toner image, a transfer belt configured to transfer a toner image on the image bearing member onto the transfer material, a cleaning unit to collect the toner adhering to the transfer belt and a toner conveying device configured to convey the toner collected by the cleaning unit to a waste toner container. The toner conveying device includes an inflow port to which collected toner flows in, a toner conveying path having a discharge port, a connection member connecting the inflow port and the toner conveying path, a toner conveying member provided within the toner conveying path and configured to convey the collected toner, and a drive shaft configured to rotate and drive the toner conveying member, wherein the toner conveying member, while rotating, conveys the toner which flows in from the inflow port, falls through the connection member and accumulates in the toner conveying path, from a position where the toner falls, in a direction of the discharge port. Further, the toner conveying device includes a toner hashing member wherein the toner hashing member configured to break up the toner accumulating in the toner conveying path is provided in a region of the toner conveying path corresponding at least to an opening region serving as a connecting region between the connection member and the toner conveying member.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 is a chart for explaining results of a test of cutting a clumped toner by the toner hashing member according to the first exemplary embodiment.

DETAILED DESCRIPTION OF THE EMBODIMENTS

Various exemplary embodiments, features, and aspects of the invention will be described in detail below with reference to the drawings.

The sizes, materials, shapes, and relative positions of component parts, which will be described in the following embodiments of the present invention, are to be changed according to a configuration of devices to which the present invention is applied and also according to various conditions used.

Figure 1:
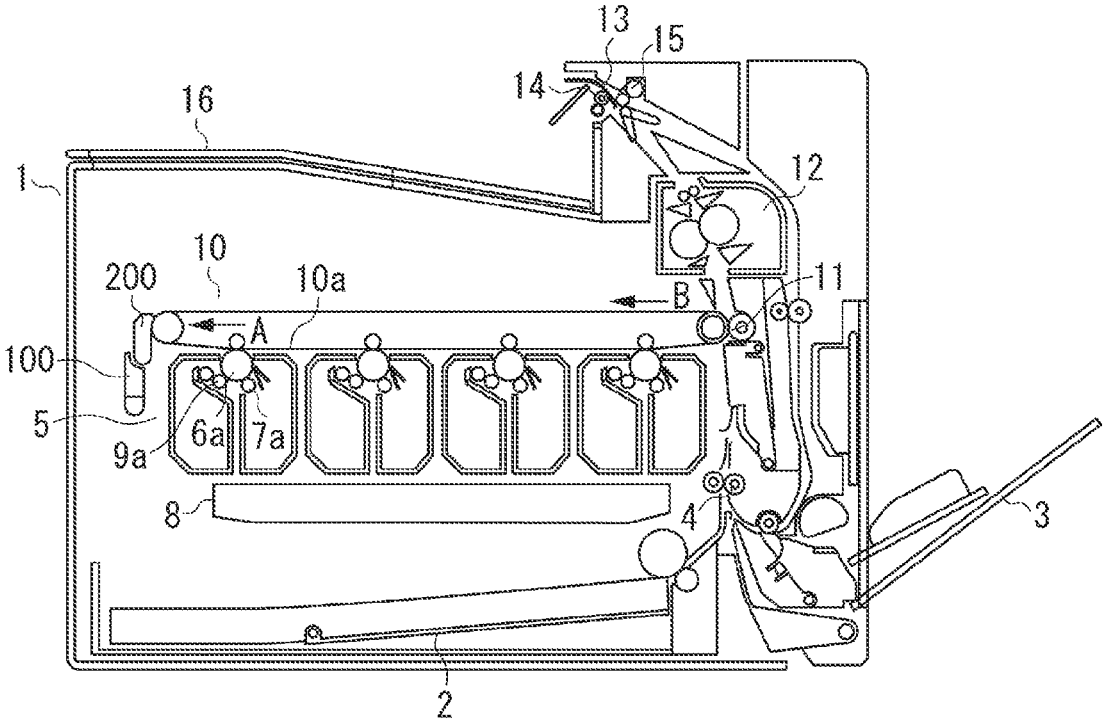
FIG. 1 is a sectional view of a main unit of an image forming apparatus according to a first exemplary embodiment of the present invention.

FIG. 1 is a schematic diagram illustrating an image forming apparatus according to a first exemplary embodiment of the present invention. An overall configuration and operations of the image forming apparatus will be described in the following. An image forming apparatus 1 is shown as a tandem type color printer using electrophotographic printing. However, the image forming apparatus 1 is not limited to electrophotographic color printers, but the image forming apparatus 1 may be copying machines, or facsimile machines.

An extractable paper cassette 2 for storing transfer material, such as paper, is provided at the bottom of the apparatus main unit. And, a manual paper feed unit is provided on the right side of the apparatus main unit in FIG. 1. When image forming is started, a sheet is separated at a time from the paper cassette 2 or from the manual paper feed 3, and supplied to registration rollers 4.

The apparatus 1 is formed by arranging in a row image forming units which correspond to colors of yellow, magenta, cyan, and black. Each image forming unit 5 includes a photosensitive drum 6 as an image bearing member, a charging member 7, a development member 9, and a blade. In FIG. 1, a photosensitive drum 6*a*, a charging member 7*a*, and a development member 9*a* of an image forming unit 5*a* for yellow are described as a representative, each with a sign "a" added. Other image forming units for magenta, cyan, and black are configured in a similar way as the image forming unit 5*a* for yellow. A scanner unit 8 is mounted at a lower position in each image forming unit.

The scanner unit 8 forms an electrostatic image on the photosensitive drum 6 by irradiating the drum 6 with a laser beam based on image information. The image forming unit 5 develops an electrostatic latent image formed on the photosensitive drum 6 by the scanner unit 8, using the development unit 9 which causes a toner to adhere to the latent image to create a toner image. The photosensitive drum 6 is an image bearing member configured to carry the toner image obtained by development. The intermediate transfer belt 10 facing each photosensitive drum is a rotatable endless transfer belt, which is entrained around a plurality of rollers. Primary transfer rollers are arranged at positions where each primary transfer roller forms a primary transfer member jointly with a photosensitive drum across the intermediate transfer belt. At each primary transfer member, a toner image is transferred from the photosensitive drum 5 to the intermediate transfer belt 10 by the primary transfer roller, to which a voltage is applied. In this first exemplary embodiment, an intermediate transfer unit, formed as a single unit including the intermediate transfer belt, a plurality of the belt suspension rollers, and the primary transfer rollers, is detachably mounted to the apparatus main unit.

A secondary transfer roller 11 as a secondary transfer member, which is in contact with the intermediate transfer belt, forms a secondary transfer unit jointly with an opposite-side roller across the intermediate transfer belt. At the secondary transfer unit, the toner image transferred to the surface of the intermediate transfer belt is transferred to a transfer material.

A fixing unit 12 is arranged downstream from the secondary transfer unit in a transfer material conveying direction. The toner image on a transfer material obtained by secondary transfer is fixed by the fixing unit 12. Then, the conveying path is switched by a two-sided flapper 13 and sent to either a discharge roller pair 14 or to a switch-back roller pair 15. A transfer material, if conveyed to the side of the switch-back roller pair 15, is inverted and conveyed by the switch-back roller pair 15. After the transfer material has again passed through a registration roller 4, the secondary transfer unit 11, and the fixing unit 12, the transfer material is conveyed to the discharge roller pair 14. After passing through the discharge roller pair 14, the transfer material is discharged to a transfer material loading unit 16.

A cleaning unit 100, which is located in contact with the intermediate transfer belt, collects the toner and paper particles adhering to the intermediate transfer belt. The cleaning unit 100 has a toner conveying device 200 configured to convey the toner collected by the cleaning unit 100 to a waste toner container (not illustrated). The cleaning unit 100 according to this first exemplary embodiment is constructed integrally with the intermediate transfer unit, and these two units can be integrally mounted and detached.

Figure 2:
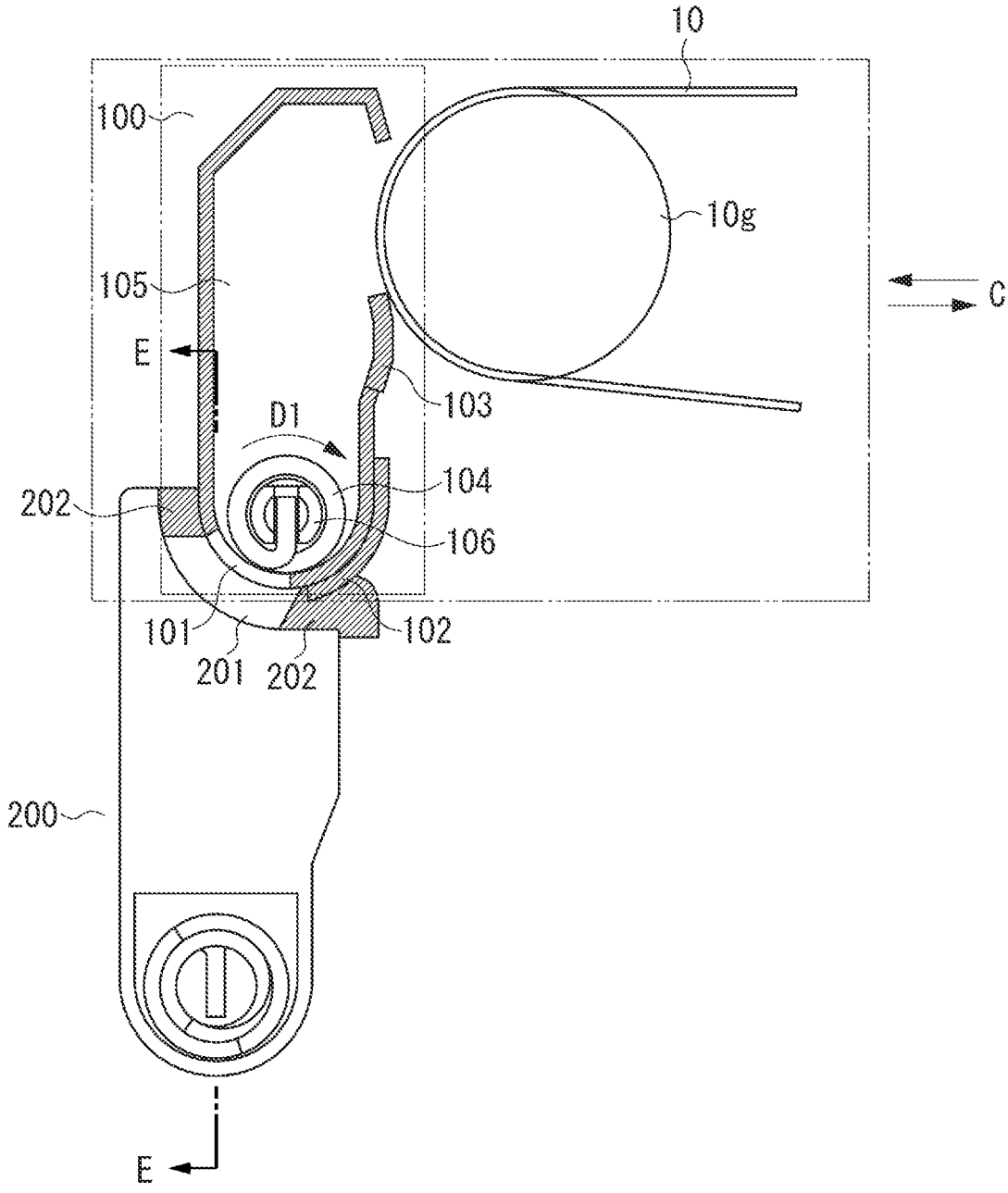
FIG. 2 is a diagram for explaining a configuration involving a cleaning unit and a toner conveying device according to the first exemplary embodiment.

The cleaning unit 100 and the toner conveying device 200 will be described with reference to FIG. 2. FIG. 2 is a sectional view illustrating the cleaning unit 100 and the toner conveying unit 200. The intermediate transfer unit can be attached and detached to and from the image forming apparatus in directions indicated by arrows C. The toner conveying device 200 is fixed to the apparatus main unit. When the intermediate transfer unit is mounted to the apparatus main unit, the cleaning unit 100 and the toner conveying device 200 are connected. Specifically, a toner discharge port 101 of the cleaning unit 100 is connected to a toner inflow port 201 of the toner conveying device 200. The cleaning unit 100 mainly includes the toner discharge port 101, a shutter 102, a cleaning blade 103, a toner conveying member 104, a toner conveying path 105, and a drive shaft 106.

When the intermediate transfer unit has been removed from the apparatus main unit, if the toner discharge port 101 is left bare, the residual toner is likely to spill out of the toner conveying path 105 and contaminate the inside of the image forming apparatus. To prevent a spill of toner, the cleaning unit 100 has a shutter 102 to close the discharge port 101. When the intermediate transfer unit is mounted on the image forming apparatus, the shutter 102 moves to open, and the toner discharge port 101 is connected with the toner inflow port 201.

To prevent the toner from spilling out of a clearance between the toner discharge port 101 and the toner inflow port 201, the circumference of the toner inflow port 201 is covered with a sealing member 202. For the sealing member 202, an elastic material is used, such as polyurethane. The cleaning blade is arranged to face a driven roller 10*g* configured to suspend the intermediate transfer belt. The cleaning blade 103 is kept in contact at its tip with the intermediate transfer belt with a specified contact pressure.

The toner conveying member 104, which is spirally coiled, is located at a low position of the cleaning blade 103 in the toner conveying path 105 and connected at one end to the drive shaft 106. The drive shaft 106 is rotatable by a drive unit, such as a motor (not illustrated). When the drive shaft 106 is operated, the toner conveying member 104 is rotated in a specified direction D1.

Figure 3:
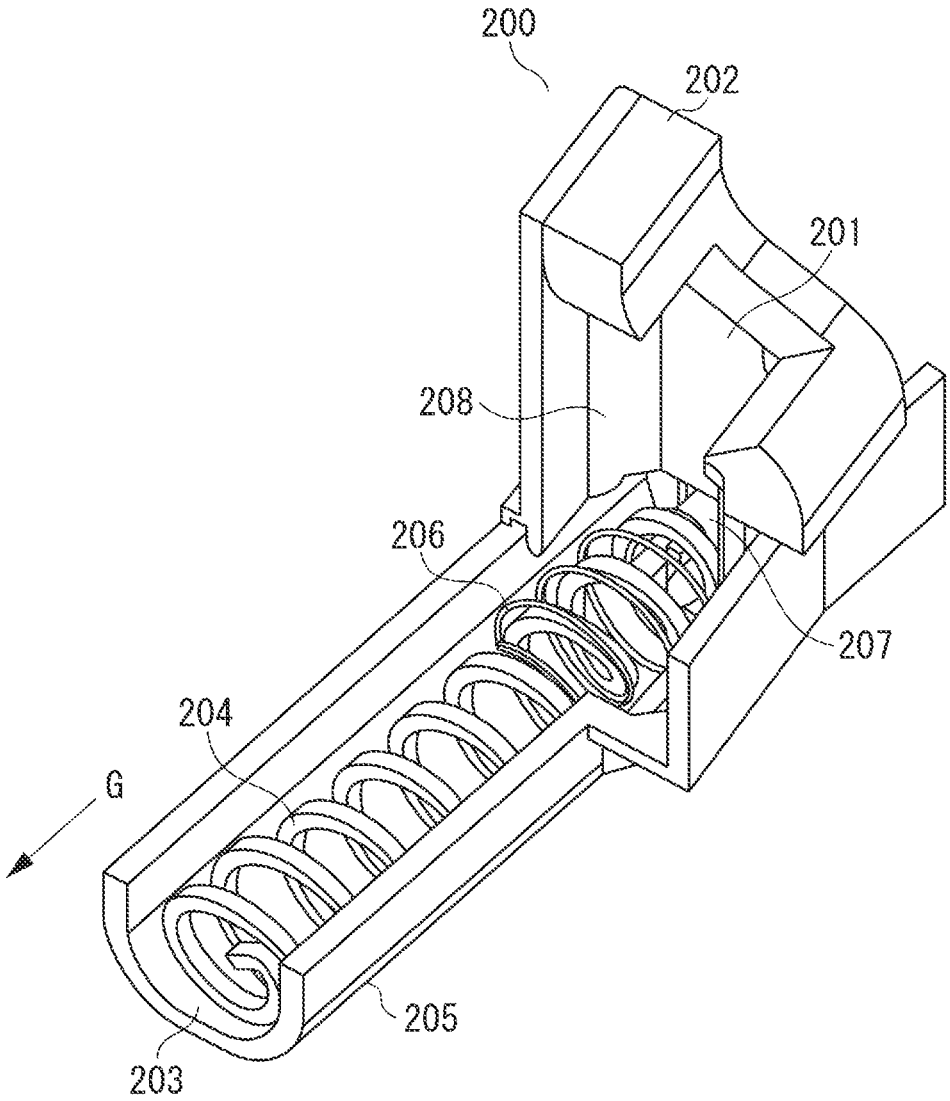
FIG. 3 is a perspective view showing the configuration of the toner conveying device according to the first exemplary embodiment.
Figure 4:
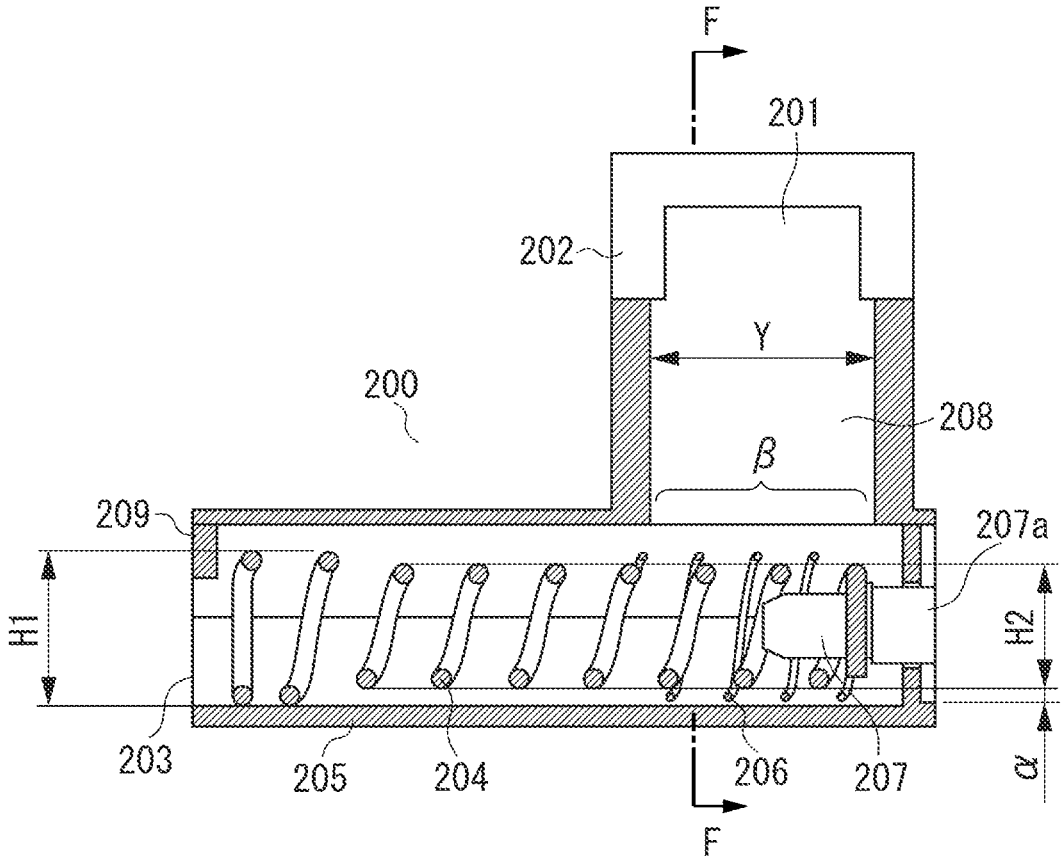
FIG. 4 is a view taken along line E-E of the toner conveying device according to the first exemplary embodiment.
Figure 5:
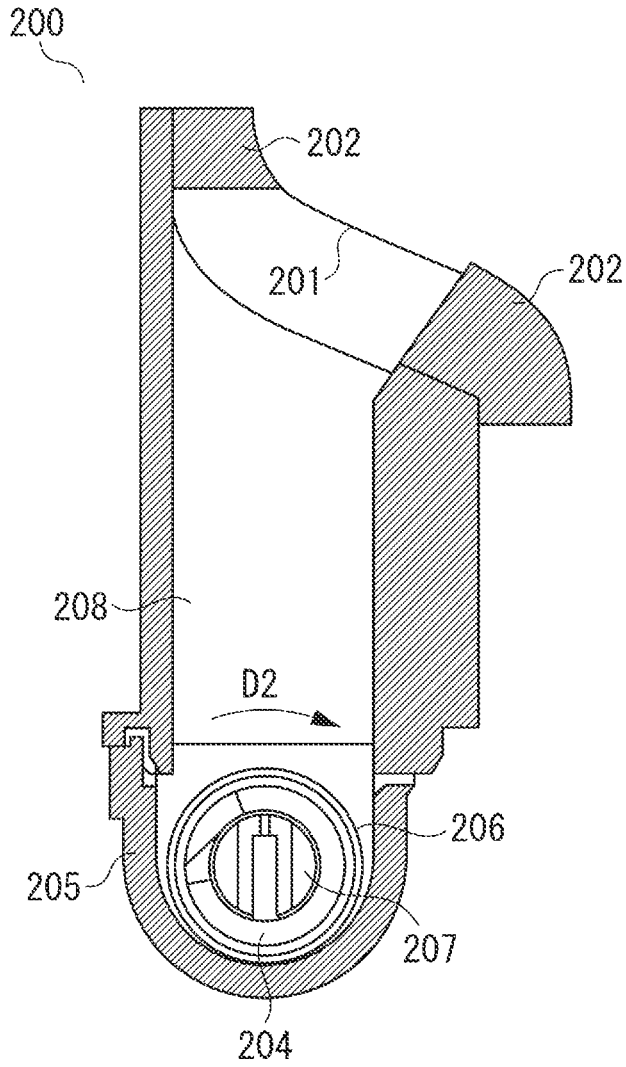
FIG. 5 is a view taken along line F-F of the toner conveying device according to the first exemplary embodiment.

After the secondary transfer ends, the residual toner on the intermediate transfer belt 10 is scraped out by the cleaning blade 103, and falls in a free fall and accumulates in the toner conveying path 105. As the toner conveying member 104 rotates in a specified D1 direction, the residual toner is conveyed towards the toner discharge port 101. The residual toner, when reaching the discharge port 101, is discharged into the toner inflow port of the toner conveying device The toner conveying device 200 in the image forming apparatus will be described referring to FIGS. 3 to 5. FIG. 3 is a perspective view of the inside of the toner conveying device 200. FIG. 4 is a sectional view taken along line E-E in the toner conveying device 200 as illustrated in FIG. 2. FIG. 5 is a sectional view taken along line F-F in the toner conveying device 200 as illustrated in FIG. 4. In this first exemplary embodiment, the toner conveying member 204 and a toner hashing member 206 have a circular cross section. In FIG. 3, however, for ease of visual recognition, the toner conveying member 204 and the toner hashing member 206 are illustrated as having a square cross section.

The toner conveying device 200 includes the toner inflow port 201, the sealing member 202, the toner discharge port 203, the toner conveying member 204, the toner conveying path 205, the toner hashing member 206, a drive shaft 207, and a duct 208, which are arranged as illustrated in FIG. 3. In this case, the duct 208 is the toner conveying path running in a vertical direction. In practice, the toner conveying device 200 has the sealing member 202 and an upper cover for the toner conveying path 205. However, in FIG. 3, for convenience of explanation, the upper cover is omitted.

A hollow duct (connection member) 208 is a section communicating between the toner inflow port and the toner conveying member 204. The duct 208, arranged to extend in a vertical direction, guides to the toner conveying member 204, the residual toner falling in a free fall through the duct 208 (inside the connection member) from the toner inflow port 201. The width of the duct 208 in this embodiment is Y=12.5 mm.

The residual toner that has flowed from the toner discharge port 101 into the toner inflow port 201 falls in a free fall within the duct 208, and accumulates in the toner conveying path 205. The falling toner accumulates and comes to contact the toner conveying member 204. A connection region where the duct 208 meets the toner conveying path 205 is referred to as an opening region. Therefore, at least the toner conveying path 205 needs to cover an underside of the toner conveying member 204. In the toner conveying path 205 according to this embodiment, the whole body of the toner conveying member 204 is covered when the upper cover is mounted as described above. The toner discharge port 203 is located at one end of the toner conveying path 205, and the residual toner in the toner conveying path 205 is conveyed from the toner inflow port 201 to the toner discharge port 203 (in a direction of arrow G). The residual toner that has been conveyed to the toner discharge port 203 is collected in a toner collecting box (not illustrated).

The toner conveying member 204 in this embodiment is a right-handed coil spring (first coil spring) made of steel wire class C (SW-C) with a coil rod diameter of 1.2 mm and a pitch of 6 mm. The toner conveying member 204 is connected with the drive shaft 207 and rotates with the drive shaft 207. In the toner conveying member 204, the external diameter of the coil rod is 10 mm (H1) for two turns on the side of the discharge port 203 and the external diameter of the coil for the other turns of the coil rod is 8 mm (H2) as illustrated in FIG. 4. The toner conveying member is configured so that there is a clearance $\alpha$ of 1 mm between the toner conveying member 204 and the toner conveying path 205. A letter $\beta$ in FIG. 4 represents the opening region.

In the toner conveying member 205, its toner conveyance capacity becomes higher as a projected area of the toner conveying member 204 becomes larger as viewed from the direction illustrated in FIG. 5. The toner conveying member 204 has such a shape that its toner conveyance capacity increases as its distance to the toner discharge port 203 decreases. The toner conveying member 204 should preferably have a toner conveying capacity with as much allowance as possible, at least more than the toner supply amount to the toner conveying device 200. The toner conveying member 204 is connected at its one end with the drive shaft 207. Therefore, as the drive shaft 207 rotates at 210 rpm in the D2 direction, the toner conveying member 204 rotates at 210 rpm in the D2 direction, too (FIG. 5).

In this embodiment, the toner conveying member 204 slides along the toner conveying path 205 with only two turns of the coil of the toner conveying member 204, which are located close to the discharge port 203. These two turns of the coil 204 have a larger external diameter of 10 mm (H1) than the other turns of the coil. Because of this coil structure, the toner conveying member 204 is never subjected to a resistance which may occur from abrasion with the toner conveying path 205. Therefore, toner conveying member 204 rotates steadily.

A rib 209 is provided on the toner conveying path 205. Since the rib 209 regulates the motion of a discharge-port-side end portion of the toner conveying member 204, the toner conveying member 204 is prevented from being separated from the drive shaft 207 of the toner conveying member 204.

Why collected toner tends to clump together will be considered. Residual toner is collected together with unwanted substances such as dust in the image forming apparatus and paper dust, and transfer material by the cleaning blade 103. It is possible that the unwanted substances cause the residual toner to clump together. Since the fluidity of residual toner which includes unwanted substances has been reduced to a larger degree compared with the fluidity of toner without unwanted substances, the residual toner is more likely to coagulate. Since a large proportion of paper dust is paper fiber exfoliated from paper, it is considered that residual toner including lots of paper dust is highly liable to entanglement and aggregation.

The residual toner that has fallen in a free fall from the inflow port 201 into the toner conveying device 200 is conveyed in the toner conveying path 205 while it is hoisted by the toner conveying member 204 from where it has fallen towards the downstream side in the rotating direction. The residual toner that has been hoisted aggregate with paper fiber entangled in a space between the toner conveying member 204 and the toner conveying path 205. The residual toner that has fallen from the duct 208 is conveyed by the toner conveying member 204 while it is hoisted from the opening region to the downstream side. Therefore, the residual toner falling through the duct 208 sometimes coalesces with residual toner hoisted at the opening region of the toner conveying member 204. If by coalescence the toner further clumps together (increases in mass), the whole opening region for toner delivery of the toner conveying device 200 may get jammed, resulting in toner clogging.

To solve clogging, a toner hashing member 206 is provided in this embodiment. The toner hashing member 206 is a coil spring of SW-C material with a wire diameter of 0.3 mm, wound right-handed, with a 4 mm pitch, external diameter of 9.5 mm, 12.5 mm in length (second coil spring). The toner hashing member 206 is configured to contact a toner falling to the toner conveying device 204 at its region close to the open region. In other words, the clearance between the opening region and the toner hashing member 206 in the toner falling direction is smaller than the clearance between the opening region and the toner conveying member 204. More specifically, the external diameter of the toner hashing member 206 only has to be larger than the external diameter of the toner conveying member 204 at a region corresponding to the opening region. The toner hashing member 206 only has to contact the residual toner falling through the duct 208 at the toner delivery opening earlier than the toner conveying member 204 does. The toner hashing member 206 is prevented from being separated from the drive shaft 207 in the thrust direction since an end turn of the toner hashing member 206 is pinched between the toner conveying member 204 and the stepped portion 207*a* of the drive shaft 207.

Since the one turn (on the drive shaft side) of the toner hashing member 206 is linked to the drive shaft 207, when the drive shaft 207 rotates in the D2 direction, the toner hashing member 206 also rotates in the D2 direction at the same rotating speed in synchronism with the toner conveying member 204. If the same coil winding direction and rotating direction as in the toner conveying member 204 are set, the toner hashing member 206 can also convey toner, though not much toner is conveyed.

The toner conveying member 206 according to this embodiment uses a coil of thinner diameter than the toner conveying member 204 and cuts into clumped toner (aggregated toner). An area in which a thin-diameter coil contacts toner is smaller than in thick coils. As the diameter of a coil decreases, the surface pressure of a coil increases, and the shearing force increases. Therefore, when a small-diameter coil cuts into the toner, it can break up toner clumps. When the toner hashing member 206 is rotated, it agitates the toner while it cuts up the toner, and it can cut the toner into pieces. As a result, the hard toner crumbles to be powder, so that the toner hashing member 204 can convey the residual toner steadily, thus reducing chances of toner clogging.

The toner conveying member 204 needs to have a toner conveying capacity larger than at least a toner supply amount to the toner conveying device 200, further, should have a toner conveying capacity showing as much allowance as possible. Therefore, it is not desirable to try to reduce the diameter of wire rod for the toner conveying member 204.

The toner conveying member 204 and the toner hashing member 206 are driven by the same drive shaft 207, and they rotate as one body, and there is no chance of contact vibration. Therefore, it is possible to prevent abnormal noise, image noise, and wear caused by contact vibration. If the toner hashing member 206 provided outside of the toner conveying member 204 is mounted only on the region of the inflow port 201 regardless of how long the toner conveying member 204 may be, it is possible to reduce toner clogging. Owing to this configuration, it is possible to securely prevent toner clogging in a low-cost coil spring, in which the free length is short and the number of turns of the coil is small.

To verify the capacity of cutting into clumped toner, a hashing test was performed by varying the wire rod diameter of the toner hashing member 206. More specifically, the duct 208 was detached, and residual toner was formed with pressure into clumps of about 4 mm to 5 mm in diameter. While the toner conveying member 204 and the toner hashing member 206 were rotated, toner clumps were put gently on the toner hashing member 206, and the process was observed to see what results were achieved. The amount of residual toner used was the same as the amount of residual toner produced when paper EXTRA80/A4 was passed through an image forming apparatus at a printing rate of 5%. It was confirmed whether the clumps of residual toner were cut into pieces by the toner hashing member 206 and also whether or not the residual toner could be delivered to the toner conveying member 204.

According to results of the cutting test, as illustrated in FIG. 6, if the wire rod diameter of the toner hashing member 206 is 0.7 mm or more, the advantageous effect of the present invention in breaking up the toner clumps decreases. Therefore, the residual toner stayed intact on the toner hashing member 206 in the same state that it fell there and the toner could not be delivered to the toner conveying member 204. If the wire rod diameter is so thin as 0.1 mm or 0.2 mm, there is a possibility that the wire rod is deformed at the time of transportation or assembly of component parts of an apparatus. For this reason, the wire rod diameter of the toner hashing member 206 is preferably about 0.3 mm to 0.6 mm. By this toner hashing member 206, it is possible to reduce accumulation of toner in the toner conveying path, and steadily transport toner into a toner collecting box.

If mounted close to the toner delivery opening region, the toner hashing member 206 can prevent toner clogging. Therefore, the toner hashing member 206 is configured to have a length of 12.5 mm, about the same length as the toner delivery opening region. The length of the toner hashing member 206 may be longer than the toner delivery opening region. For example, the toner hashing member 206 may have a length reaching the discharge port 203 of the toner conveying path 205. In this case, the hard clumps of residual toner can be pulverized for the whole length of the toner conveying path 205.

A coil pitch of the toner hashing member 206 is 4 mm. The coil pitch has no effect on the toner clump cutting capacity of the toner hashing member 206. The advantageous effect of the present invention remains unchanged whether the coil pitch is more than or less than 4 mm. Moreover, even if the axis of rotation of the toner hashing member 206 or the toner conveying member 204 is eccentric, this does not affect the toner clump cutting capacity of the toner hashing member 206. So long as the amount of eccentricity of the two coils is of such a degree that causes no contact vibration, the advantageous effect of the present invention remains unchanged.

The toner conveying device according to the present invention includes two toner conveying paths. By using a toner conveying device having three or more toner conveying paths, toner clogging can be prevented from occurring at the toner delivery opening range between the toner conveying paths. In this embodiment, the image forming apparatus has been described which performs intermediate transfer, but this invention can be applied to image forming apparatuses of other systems. For example, in an image forming apparatus using a convey belt which conveys transfer material, this invention can be applied to the toner delivery opening region of the toner-conveying path, in which the advantageous effect of the present invention remains unchanged. In this embodiment, the image forming apparatus has been described, in which the toner remaining on the intermediate transfer belt is collected, but this invention can be applied to apparatuses of other configurations. For example, this invention can be applied to the toner delivery opening region in the toner conveying path of the drum cleaning unit which collects the toner remaining on the photosensitive drum.

Since the basic configuration of the image forming apparatus and the toner conveying device in a second exemplary embodiment of the present invention is the same as the first exemplary embodiment, the functions and component parts which are the same as or equivalent to those in the first exemplary embodiment are designated by the same reference numerals, and their descriptions are omitted.

Figure 7:
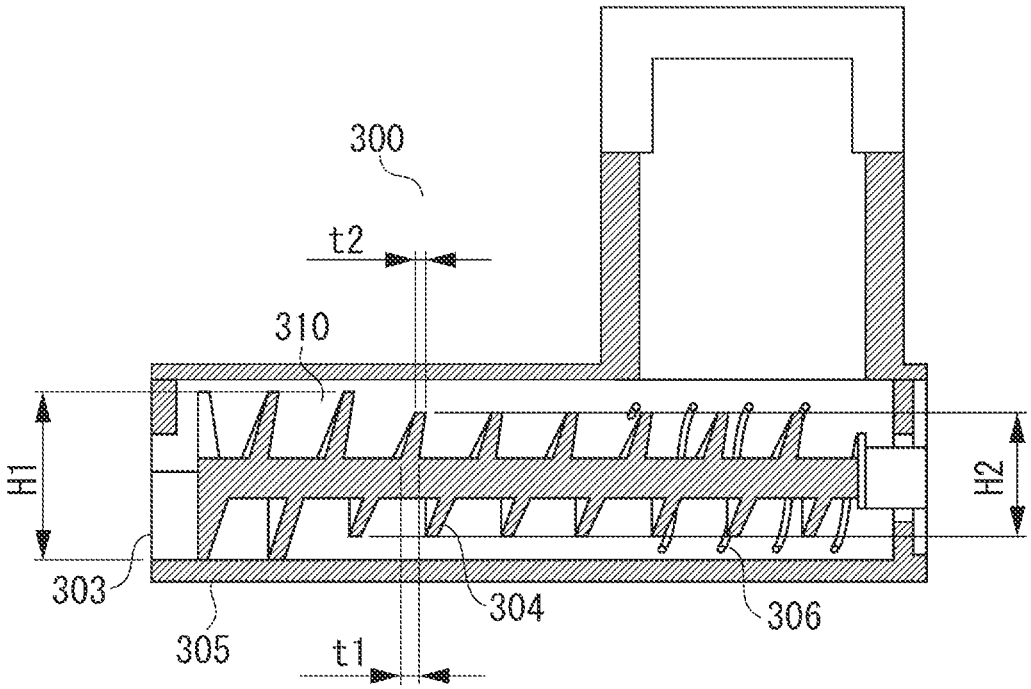
FIG. 7 is a view for explaining in detail the configuration of the toner conveying device according to a second embodiment of the present invention.

An overview of a toner conveying device 300 according to the second embodiment will be described with reference to FIG. 7. A toner conveying member 304 is made of a screw with a right-handed conveying blade 310 formed in a spiral shape on a rotating shaft. The conveying blade 310 is in a tapered shape with a blade-base thickness t1 of 12 mm, a conveying-blade tip thickness t2 of 0.7 mm, and an inter-blade pitch of 6 mm. The wire rod has an external diameter of 10 mm (H1) for two turns of the coil close to the discharge port 303, and 8 mm (H2) for the other turns of the coil. In the range of the 8-mm diameter, there is a clearance $\alpha$ of 1 mm between the toner conveying member 304 and the toner conveying path 305.

The toner hashing member 306 is a right-handed coil spring wound with a wire rod diameter of 0.3 mm, a coil pitch of 4 mm, an external diameter of 9.5 mm, and 12.5 mm in length. This coil spring is made of a wire rod with a diameter smaller than the tip thickness t2 of the conveying blade 310. As the tip thickness of the conveying blade 310 decreases, the capacity of cutting hard toner clumps increases. However, when a screw 304 with a conveying blade 310 is formed of a resin, if the tip thickness t2 of the conveying blade 310 is decreased, a risk of defective resin molding increases. Therefore, it is not desirable to use a too small thickness t2.

According to this second embodiment, even when a toner conveying member 304 has a conveying blade 310, it is possible to reduce toner accumulation in the toner conveying path and ensure steady conveyance of toner into the toner collecting box.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-145310 filed Jun. 25, 2010, which is hereby incorporated by reference herein in its entirety.

What is claimed is:

1. A toner conveying device for conveying collected toner, comprising:

a toner conveying path having a discharge port;

a toner conveying member provided within the toner conveying path and configured to convey the collected toner;

a drive shaft configured to rotate and drive the toner conveying member; and a breaker member provided in the toner conveying path and configured to break up the collected toner in the toner conveying path, wherein the toner conveying member is configured to convey the collected toner toward the discharge port by rotation of the drive shaft, and wherein the breaker member is configured to rotate to break up the collected toner in the toner conveying path.

2. The toner conveying device according to claim 1, wherein the breaker member is connected with the drive shaft and rotates integrally with the toner conveying member.

3. The toner conveying device according to claim 2, further comprising:

an inflow port to which collected toner flows in; and a connection member connecting the inflow port and the toner conveying path, wherein the toner conveying member is configured to convey a toner flowing through the inflow port, falling in the connection member and flowing into the toner conveying path via the connecting region, from a position where the toner has fallen toward the discharge port.

4. The toner conveying device according to claim 3, wherein a clearance between the connecting region and the breaker member in a toner falling direction is smaller than a clearance between the opening region and the toner conveying member.

5. The toner conveying device according to claim 4, wherein the breaker member is configured to rotate in a same direction as a rotation direction of the toner conveying path.

6. The toner conveying device according to claim 1, wherein the toner conveying member is a first coil spring made of a wire rod and helically formed and the breaker member is a second coil spring helically formed and made of a wire rod smaller in diameter than the wire rod of the toner conveying member.

7. The toner conveying device according to claim 6, an external diameter of the second coil spring is larger than an external diameter of the first coil spring.

8. The toner conveying device according to claim 1, wherein the toner conveying member is a screw having conveying blades and the breaker member is a coil spring helically formed and made of a wire rod with a diameter less than a thickness of a tip of the conveying blade.

9. The toner conveying device according to claim 8, wherein an external diameter of the coil spring is larger than an external diameter of the screw.

10. The toner conveying device according to claim 1, wherein the breaker member is provided at least at a position corresponding to a connecting region where the collected toner flows into the toner conveying path in a conveying direction of the toner conveying member.

11. The toner conveying device according to claim 1, wherein the breaker member is concentric with the toner conveying member.

12. An image forming apparatus for transferring a toner image onto transfer material, comprising:

an image bearing member carrying a toner image;

a transfer belt configured to transfer a toner image on the image bearing member onto the transfer material;

a cleaning unit to collect the toner adhering to the transfer belt; and a toner conveying device configured to convey the toner collected by the cleaning unit to a waste toner container, wherein the toner conveying device includes a toner conveying path having a discharge port, a toner conveying member provided within the toner conveying path and configured to convey the collected toner, and a drive shaft configured to rotate and drive the toner conveying member, and a breaker member provided in the toner conveying path and configured to break up the collected toner in the toner conveying path, wherein the toner conveying member is configured to convey the collected toner toward the discharge port by rotation of the drive shaft, and wherein the breaker member is configured to rotate to break up the collected toner in the toner conveying path.

13. The image forming apparatus according to claim 12, wherein a clearance between the connecting region and the breaker member in a toner falling direction is smaller than a clearance between the connecting region and the toner conveying member.

14. The image forming apparatus according to claim 12, wherein the breaker member is connected to the drive shaft and rotates integrally with the toner conveying member.

15. The image forming apparatus according to claim 12, wherein the toner conveying member is a first coil spring made of a wire rod and helically formed, and the breaker member is a second coil spring helically formed and made of a wire rod smaller in diameter than the wire rod of the toner conveying member.

16. The image forming apparatus according to claim 15, wherein an external diameter of the second coil spring is larger than an external diameter of the first coil spring.

17. The image forming apparatus according to claim 12, wherein the toner conveying member is a screw with conveying blades and the breaker member is a coil spring helically formed and made of a wire rod with a diameter less than a thickness of a tip of the conveying blade.

18. The image forming apparatus according to claim 17, wherein an external diameter of the coil springs is larger than an external diameter of the screw.

19. The image forming apparatus according to claim 12, wherein the breaker member is configured to rotate in a same direction as a rotation direction of the toner conveying path.

20. The image forming apparatus according to claim 19, further comprising:

an inflow port to which collected toner flows in; and a connection member connecting the inflow port and the toner conveying path, wherein the toner conveying member is configured to convey a toner flowing through the inflow port, falling in the connection member and flowing into the toner conveying path via the connecting region, from a position where the toner has fallen toward the discharge port.

21. A toner conveying device for conveying collected toner, comprising:

a toner conveying path having a discharge port;

a toner conveying member provided within the toner conveying path and configured to convey the collected toner;

a drive shaft configured to rotate and drive the toner conveying member; and a toner contact member provided within the toner conveying path and configured to contact the collected toner;

wherein the toner conveying member is configured to convey the collected toner toward the discharge port by rotation of the drive shaft, wherein the toner conveying member includes a plurality of conveying portions configured to rotate by the drive shaft to convey the collected toner toward the discharge port, and wherein the toner contact member includes a toner contact portion that is smaller in thickness than the conveying portions in a toner conveying direction and configured to rotate by the drive shaft.

22. The image forming apparatus according to claim 21, wherein the toner conveying member is a first coil spring made of a first wire rod and helically formed and the toner contact member is a second coil spring helically formed and made of a second wire rod, wherein the conveying portions include the first wire rod, the toner contact portion includes the second wire rod, and the second rod is smaller in thickness than the first wire rod in the toner conveying direction.

23. The image forming apparatus according to claim 21, wherein the toner conveying member is a screw having conveying blades and the toner contact member is a coil spring helically formed and made of a wire rod, and wherein the conveying portions include the conveying blades, the toner contact portion includes the wire rod, and the wire rod is smaller in thickness than the conveying blades in the toner conveying direction.

* * * * *